US005896348A

United States Patent [19]

Lyon

[11] Patent Number: 5,896,348

[45] Date of Patent: Apr. 20, 1999

[54] METHOD AND TIMEPIECE FOR DISPLAYING TIME USING GROUPED BINARY INDICATORS

[76] Inventor: Zachary W. Lyon, 1418 Glenwood Ave., Raleigh, N.C. 27605

[21] Appl. No.: 08/874,151

[22] Filed: Jun. 13, 1997

[51] Int. Cl.[6] ..... G04C 17/02

[52] U.S. Cl. ..... 368/223; 368/240; 368/241; 368/242

[58] Field of Search ..... 368/241, 239, 368/240

[56] References Cited

U.S. PATENT DOCUMENTS

| | | | |
|---|---|---|---|
| 3,750,384 | 8/1973 | Miller et al. | 58/50 R |
| 4,041,692 | 8/1977 | Marshino | 368/82 |
| 4,254,487 | 3/1981 | Lee | 368/29 |
| 4,370,068 | 1/1983 | Han | 368/240 |
| 4,459,034 | 7/1984 | Kawabata et al. | 368/240 |
| 4,803,672 | 2/1989 | Zang | 368/241 |
| 4,920,524 | 4/1990 | Kotob | 368/240 |
| 5,199,009 | 3/1993 | Svast | 368/240 |
| 5,228,013 | 7/1993 | Bik | 368/223 |

OTHER PUBLICATIONS http://www.sonic.net/~chronart/Timecapsule.html (printed Dec. 9, 1997).

*Primary Examiner*—Bernard Roskoski
*Attorney, Agent, or Firm*—Steven L. Nichols

[57] ABSTRACT

A novel method or convention of tracking and displaying the passage of time can be implemented in a variety of decorative and interesting timepiece configurations. Three groups of indicators are used. Each group of indicators is distinguishable from the other two groups. Each indicator is capable of displaying one of two states and can be readily switched between the two states. The first group consists of twelve indicators with the number of indicators in one of the two states being indicative of the hour. The second group consists of five indicators with the number of indicators in one of the two states being indicative of the passage of a multiple of ten minutes. The third group consists of nine indicators with the number of indicators in one of the two states being indicative of the passage of a minute. In this manner, the current time is indicated.

20 Claims, 7 Drawing Sheets

METHOD AND TIMEPIECE FOR DISPLAYING TIME USING GROUPED BINARY INDICATORS

FIELD OF THE INVENTION

The present invention relates to the field of horology, the science and history of keeping and displaying the time. More particularly, the present invention relates to method and timepiece for displaying time with a series of grouped indicators, each of which can exhibit one of two states.

BACKGROUND OF THE INVENTION

Throughout history, a wide variety of devices have been used to measure and mark the passage of time. Sundials, hourglasses, analog clocks, digital watches, ball clocks, water clocks and atomic clocks are some examples of devices that are and have been used to track and display the passage of time.

In today's world, timepieces are ubiquitous. Most people wear a wristwatch so as to be constantly apprised of the time. Additionally, most rooms at home or in the workplace have a wall clock or some other timepiece. Our computers, televisions, VCRs and microwave ovens typically incorporate a clock and display the time.

Because keeping track of the time is so important for most people and because timepieces are so universal, there is a constant need for novel, interesting and creative methods and decorative devices for keeping and displaying the time.

SUMMARY OF THE INVENTION

Accordingly, it is an object of the present invention to meet the above described needs and others. Specifically, it is an object of the present invention to provide a novel method that can be applied to any device for keeping and displaying the time. It is a further object of the invention to provide such a device.

Additional objects, advantages and novel features of the invention will be set forth in the description which follows or may be learned by those skilled in the art through reading these materials or practicing the invention. The objects and advantages of the invention may be achieved through the means recited in the attached claims To achieve the stated and other objects of the present invention, as embodied and described below, the invention may include first, second and third groups of indicators where each indicator can exhibit one of two states and can be switched to exhibit either of the two states. The amount of indicators of the first group exhibiting one of the two states indicates an elapsed number of hours. The amount of indicators of the second group exhibiting one of the two states indicates an elapsed number of minutes in multiples of ten. The amount of indicators of the third group exhibiting one of the two states indicates an elapsed number of minutes. Accordingly, the first, second and third groups of indicators, taken together, indicate a time of day. Additionally, the indicators of each group which are one of the two states may be reordered at the end of a cycle, for example, a sixty second cycle.

The number of indicators of the first group may be twelve or twenty-four. The number of indicators of the second group may be five. The number of indicators of the third group may be nine. The first, second and third groups of indicators may be arranged in substantially concentric circles.

The indicators may be lights and the two states may be on and off. Alternatively, the indicators may be mechanical items that shift between a first position and a second position. Still further, the indicators may change between a first color and a second color.

The first second and third groups of indicators may be distinguishable from each other by size, shape, color, orientation, spatial grouping or any combination thereof. The timepiece of the present invention may also include an indicator for indicating ante-meridiem or post-meridiem.

Finally, The present invention may include a column of numbers, with the indicators of the first, second and third groups arranged, by group, into three columns next to the column of numbers.

The present invention also encompasses a method of keeping and displaying time by: providing a first group of indicators each of which can exhibit one of two states and each of which can be switched to exhibit either of the two states; indicating an elapsed number of hours by an amount of indicators of the first group exhibiting one of the two states; providing a second group of indicators each of which can exhibit one of two states and each of which can be switched to exhibit either of the two states; indicating an elapsed number of minutes in multiples of ten by an amount of indicators of the second group exhibiting one of the two states; providing a third group of indicators each of which can exhibit one of two states and each of which can be switched to exhibit either of the two states; and indicating an elapsed number of minutes by an amount of indicators of the third group exhibiting one of the two states.

The step of providing a first group of indicators may be performed by providing twelve or twenty-four indicators. The step of providing a second group of indicators may be performed by providing five indicators. The step of providing a third group of indicators may be performed by providing nine indicators;

The method of the present invention may further include arranging the first, second and third groups of indicators in substantially concentric circles. More generally, the method may include distinguishing the first second and third groups of indicators from each other by size, shape, color, orientation or spatial grouping.

Finally, the method of the present invention may include indicating with an indicator ante-meridiem or post-meridiem. The method may also include arranging the first, second and third groups into three columns, one column per group; and disposing a column of numbers next to the columns of indicators.

BRIEF DESCRIPTION OF THE DRAWINGS

The accompanying drawings illustrate the present invention and are a part of the specification. Together with the following description, the drawings demonstrate and explain the principles of the present invention. In the drawings.

DETAILED DESCRIPTION OF THE PREFERRED EMBODIMENTS

Using the drawings, the preferred embodiments of the present invention will now be explained.

According to the principles of the present invention, three distinguishable groups of indicators are driven by a clock, electronic circuitry or other time keeping device to display the current time. An indicator, for purposes of the present invention, may be anything which can exhibit at least two discernible states and which can be switched back and forth so as to exhibit either of the two states as needed.

Figure 1:
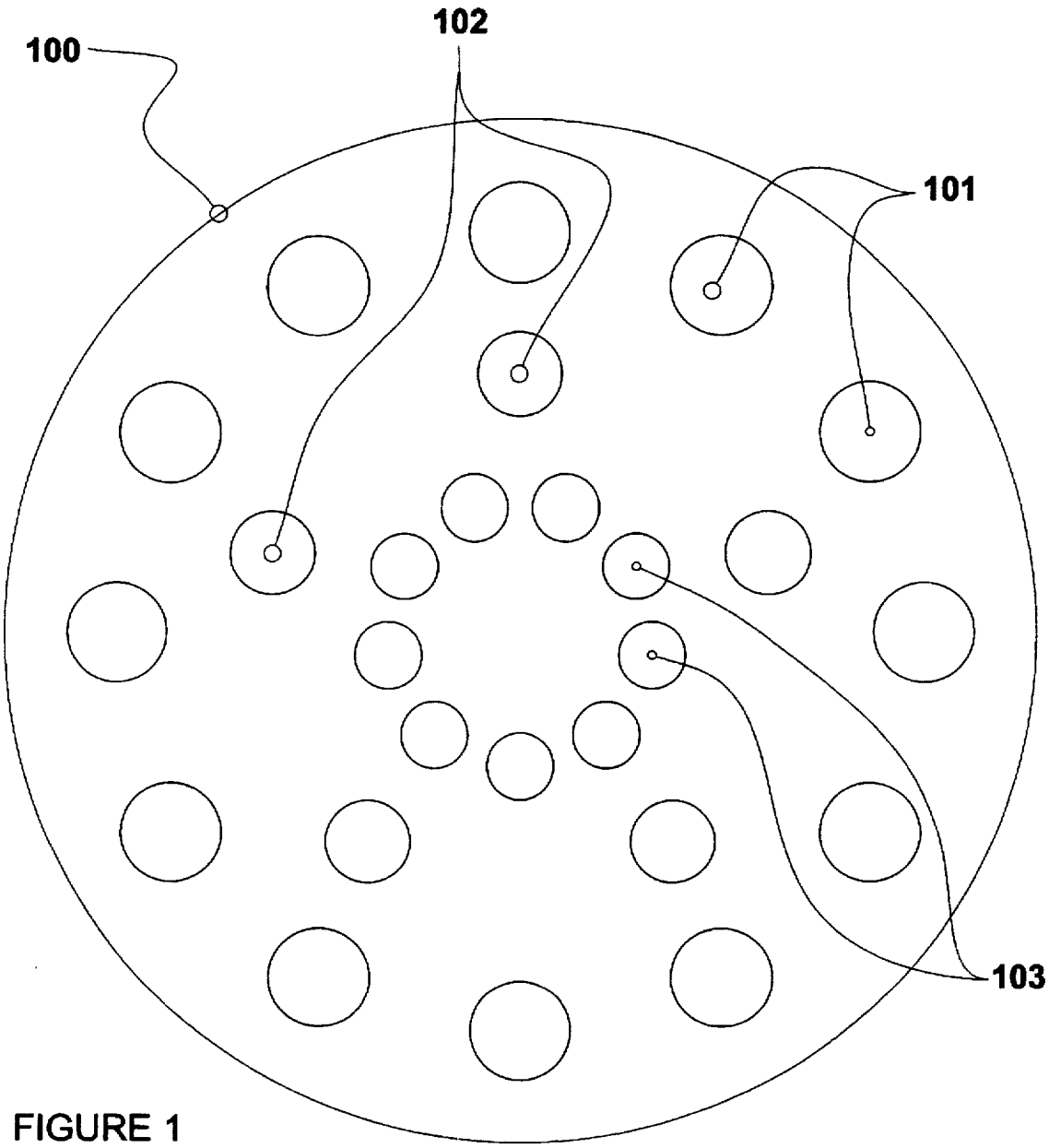
FIG. 1 is an illustration of a first embodiment of the present invention.

FIG. 1 illustrates a first embodiment of the present invention, as described. As shown in FIG. 1, a timepiece 100 includes three groups of indicators arranged in concentric circles. The first group of indicators 101 consists of twelve indicators arranged around the outer periphery of the timepiece 100. The second group of indicators 102 consists of five indicators arranged as a circle inside the circle of the first group 101. The third group of indicators 103 consists of nine indicators arranged in a circle inside the circle of the second group 102.

The first group of indicators 101 is used to display the passage of the hours in an ante-meridiem (a.m.) and post-meridiem (p.m.) system. Each indicator 102 of the second group of indicators is used to display the passage of ten minutes. Each indicator 103 of the third group is used to display the passage of a minute In FIG. 2, the timepiece 100 is illustrated displaying a particular time, i.e. 4:36 a.m. or p.m. In this example, the indicators of all three groups 101, 102 and 103 are lights which are either lit or not lit. The lights of each group are sized differently from the lights of the other groups and are arranged in a circle so as to be readily distinguishable from the other groups. Additionally or alternatively, the three groups may be distinguished by color.

Figure 2:
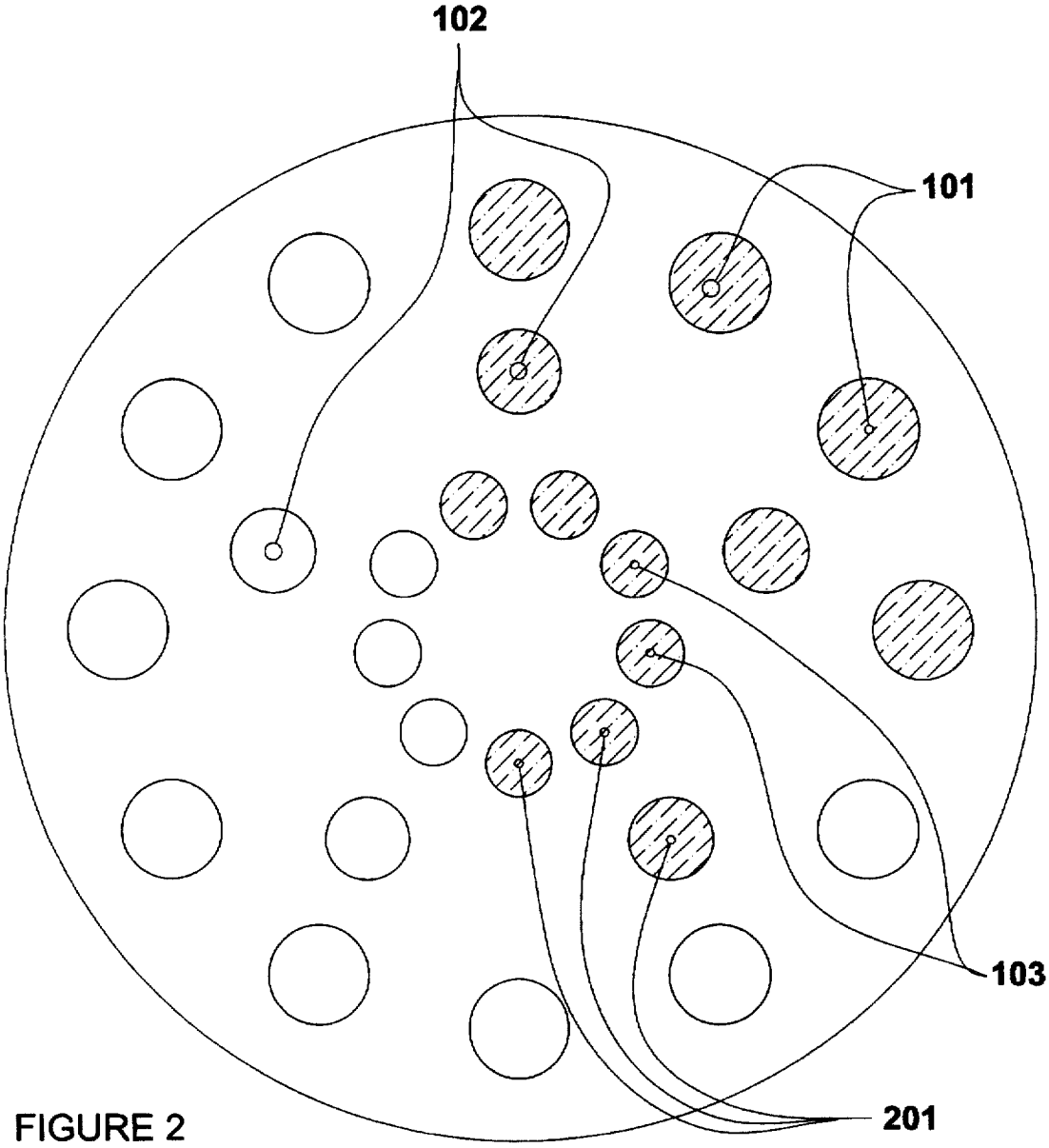
FIG. 2 is an illustration of the embodiment of the present invention of FIG. 1 displaying a particular time.

In FIG. 2, shaded circles 201 denote indicator lights which are lit. The time is read from the timepiece in the following manner. Counting from the top in a clockwise direction, there are four indicator lights of the first group 101 that are lit. Thus, the hour is indicated as four, a.m. or p.m. Counting the lit indicators of the second group 102, there are three lit indicators indicating that three multiples of ten minutes, i.e., thirty minutes, have elapsed. Finally, the lit indicators of the third group 103 are counted. In FIG. 2, the number of indicators of the third group which are lit is six, indicating that six minutes have elapsed. Accordingly, the time displayed by the timepiece is 4:36 a.m. or p.m. Military time or 24-hour time may be indicated by the same method by doubling the number of indicators in the first group 101 from twelve to twenty-four.

Figure 3:
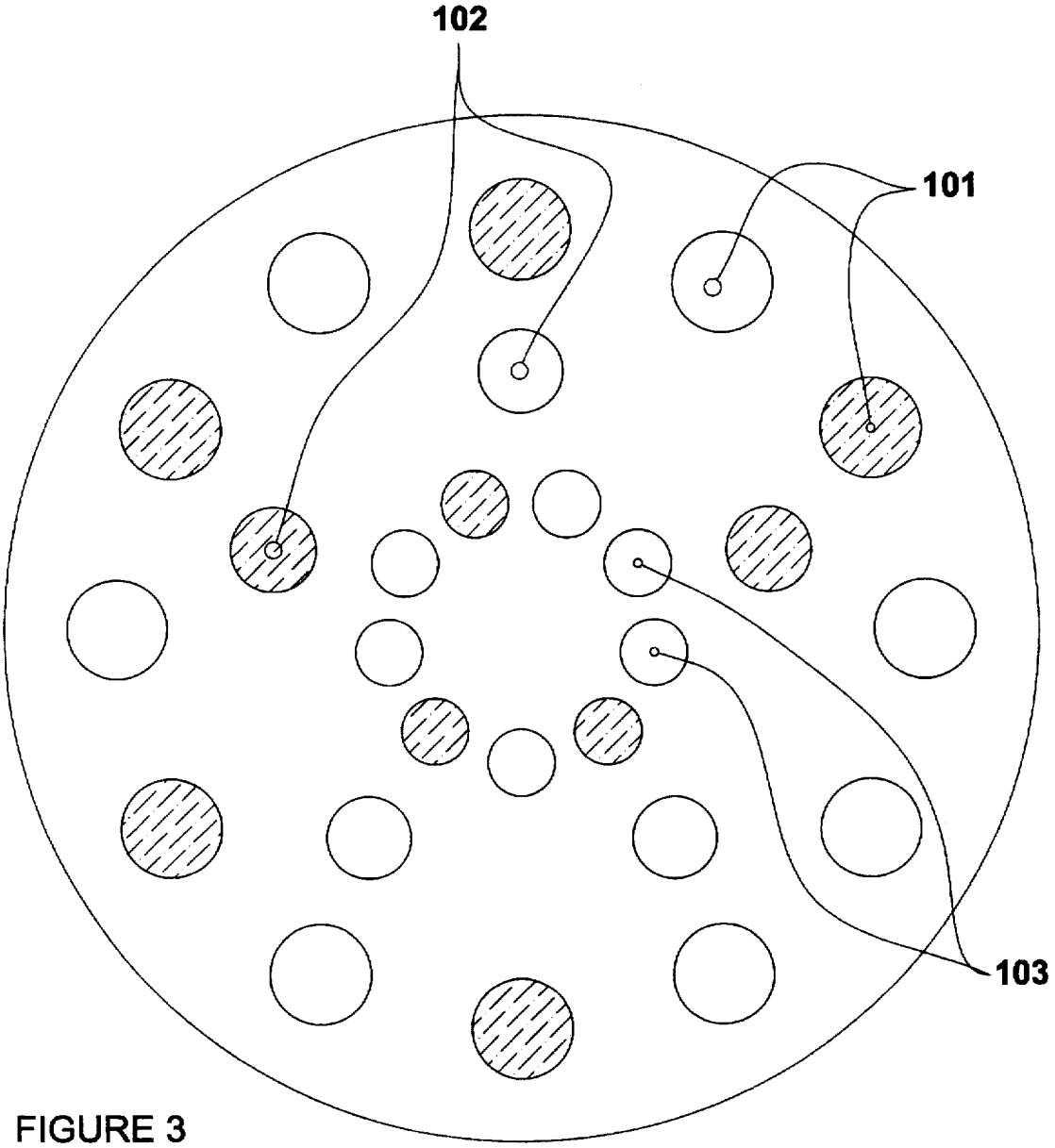
FIG. 3 is a further illustration of the embodiment of the present invention of FIG. 1 using a second method of displaying a particular time.

FIG. 3 illustrates a timepiece of the present invention displaying the time of 5:23 a.m. or p.m. The time is read as follows. Five indicator lights of the first group 101 are lit, indicating that the hour is five, a.m. or p.m. Two indicators of the second group 102 are lit indicating, the passage of twenty minutes. And, three indicators of the third group 103 are lit, indicating the passage of three minutes. Accordingly, the time displayed by the timepiece of FIG. 3 is 5:23 a.m. or p.m.

Note that, as illustrated in FIG. 3, the indicator lights 101, 102 and 103 need not be lit sequentially in a clockwise direction around the circle as illustrated in FIG. 2. Furthermore, the three groups of indicators 101, 102 and 103 need not be arranged as concentric circles, but may be in any arrangement so long as the three groups are distinguishable.

Furthermore, the indicators that are in a particular state, for example lights that are lit, may change randomly at regular intervals. For example, if the hour is five, a.m. or p.m., as in FIG. 3, five indicator lights of the first group are lit. After a defined interval of, for example, sixty seconds, the five lights that are lit will be turned off. Instantaneously thereafter five lights from the first group, determined at random, will be lit in their place. In this manner, the display is constantly changing and is made more interesting.

Figure 4:
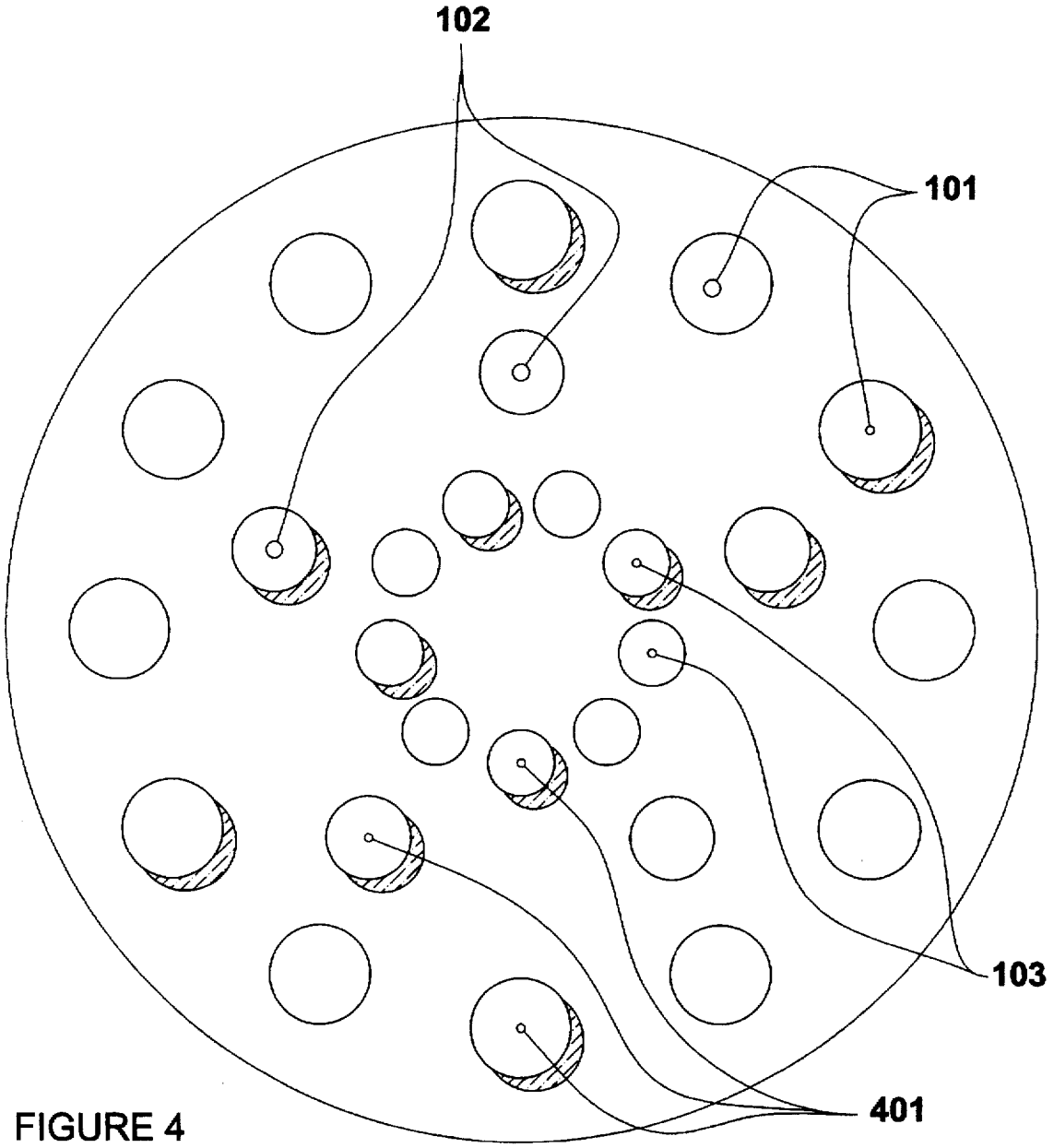
FIG. 4 is an illustration of the embodiment of the present invention of FIG. 1 using a different type of indicator to display a particular time.

FIG. 4 illustrates the use of a different type of indicator than the lights used in FIGS. 1 to 3. The indicators in FIG. 4 are cylinders that can are moved between being flush with the face of the timepiece and raised or projected above the face of the timepiece. In this example, the raised cylinders 401 indicate the time. Accordingly, counting the four raised cylinders of the first group 101, the hour indicated is four, a.m. or p.m. counting the three raised cylinders of the second group 102 and the four raised cylinders of the third group 103, the time of 4:34 a.m. or p.m. is displayed.

The indicators used according to the principles of the present invention may be anything, which at any given time, is capable of exhibiting one of at least two discernable states and is capable of being switched between those states. Examples of such indicators include, but are not limited to, lights which are lit or not lit, lights which are a first color or a second color, lights which are blinking or not blinking, mechanical items that shift from a first position or orientation to a second position or orientation, or mechanical items which are in motion or stationary. Any other indicator capable of exhibiting at least two discernable states is equivalent for purposes of the present invention to these exemplary indicators.

Moreover, the indicators of any one of the three groups can be distinguished from the indicators of the other two groups by, for example, color, size, shape, orientation, clustering or any combination of these. Any method or feature for distinguishing the three groups from each other is within the scope of the present invention.

Figure 5:
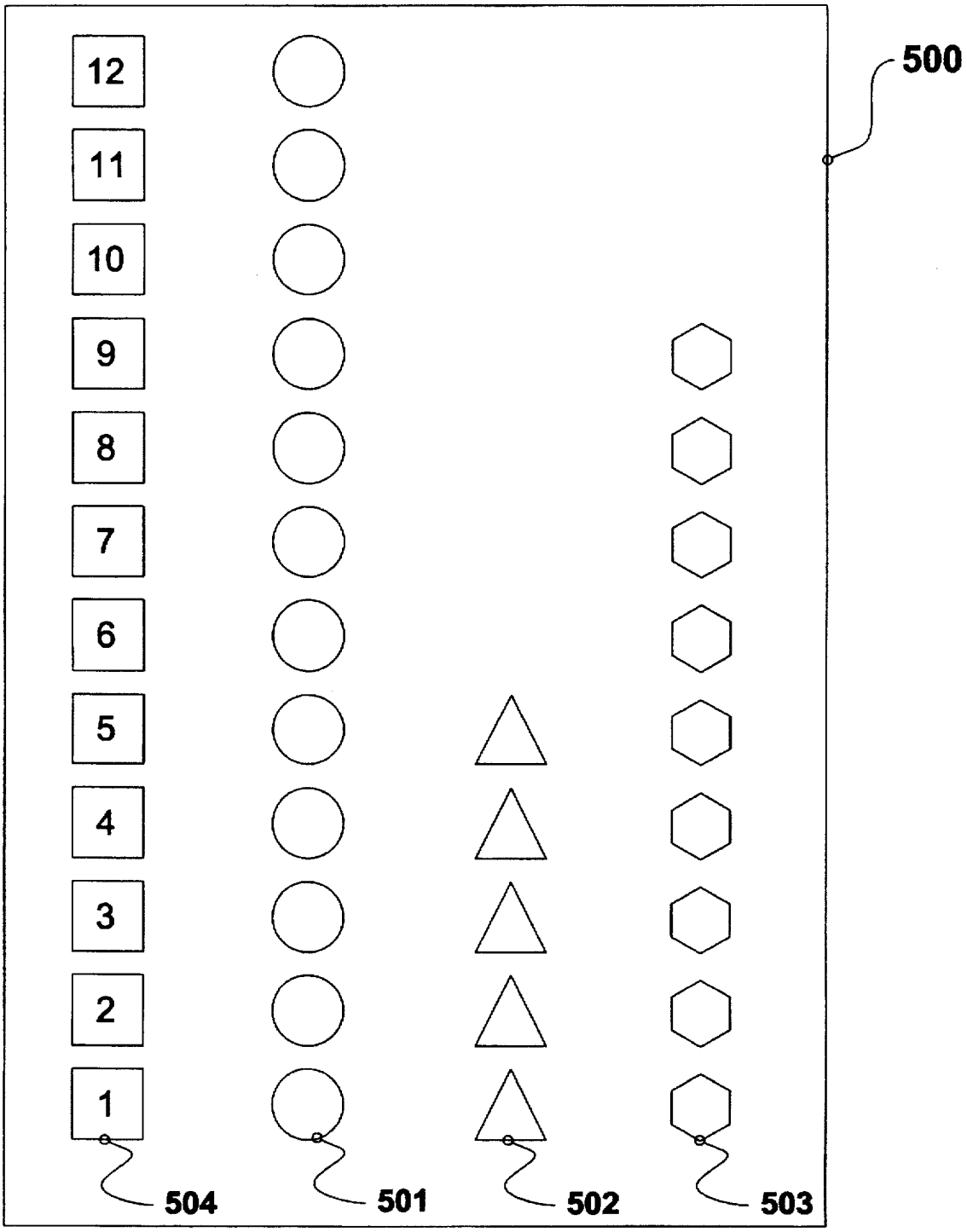
FIG. 5 is an illustration of a second embodiment of the present invention.

FIG. 5 illustrates a second embodiment of the present invention. The timepiece 500 of FIG. 5 includes a first group of indicators 501 distinguished by a circular shape and by being arranged together in a column. The second group of indicators 502 is distinguished by a triangular shape and by being arranged together in a column. The third group of indicators 503 are distinguished by a star shape and by being arranged together in a column. A column of numbers 504 is provided beside the columns of indicators to facilitate counting the number of indicators in a particular state.

Figure 6:
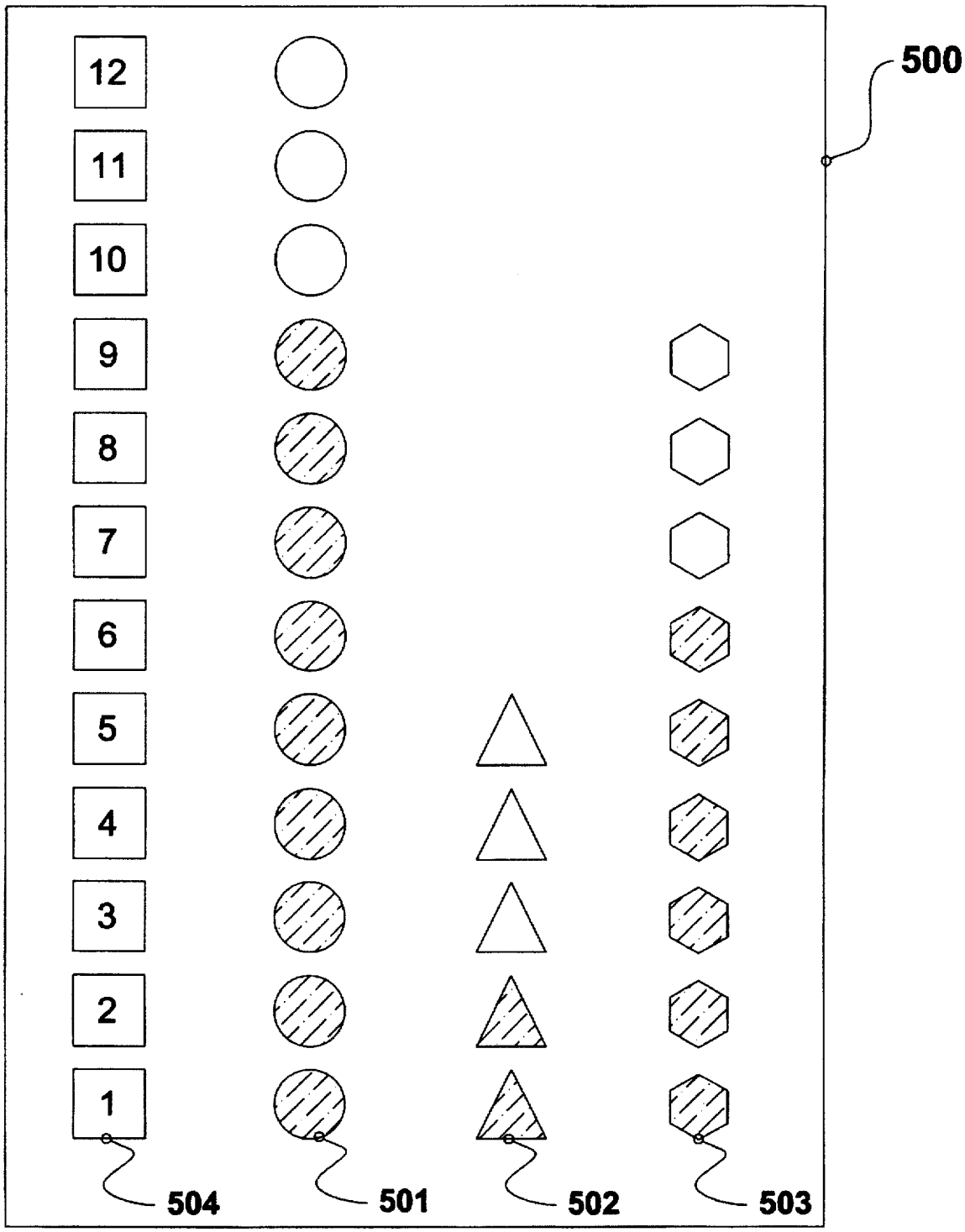
FIG. 6 is an illustration of the embodiment of the present invention of FIG. 5 displaying a particular time.

In FIG. 6, the indicators of the second embodiment of the present invention are, for example, lights which are lit or not lit. As before, shaded indicators denote indicator lights which are on. Accordingly, the particular time displayed by the timepiece 500 in FIG. 6 is 9:26 a.m. or p.m.

Nine of the indicators in the first group 501 are lit. This is readily determined because the uppermost lighted indicator of the first group 501 is adjacent the "9" in the column of numbers 504. Thus, the hour indicated is nine, a.m. or p.m. Two indicators in the second group 502 are lit, the uppermost being even with the "2"in the column of numbers 504. Six indicators in the third group 503 are lit, the uppermost being even with the "6"in the column of numbers 504. Accordingly, the time indicated is readily determined to be 9:26 a.m. or p.m.

It should be noted that the line of numbers and the three lines of indicators need not be in arranged in columns, but may be equivalently arranged as rows or curved lines.

Figure 7:
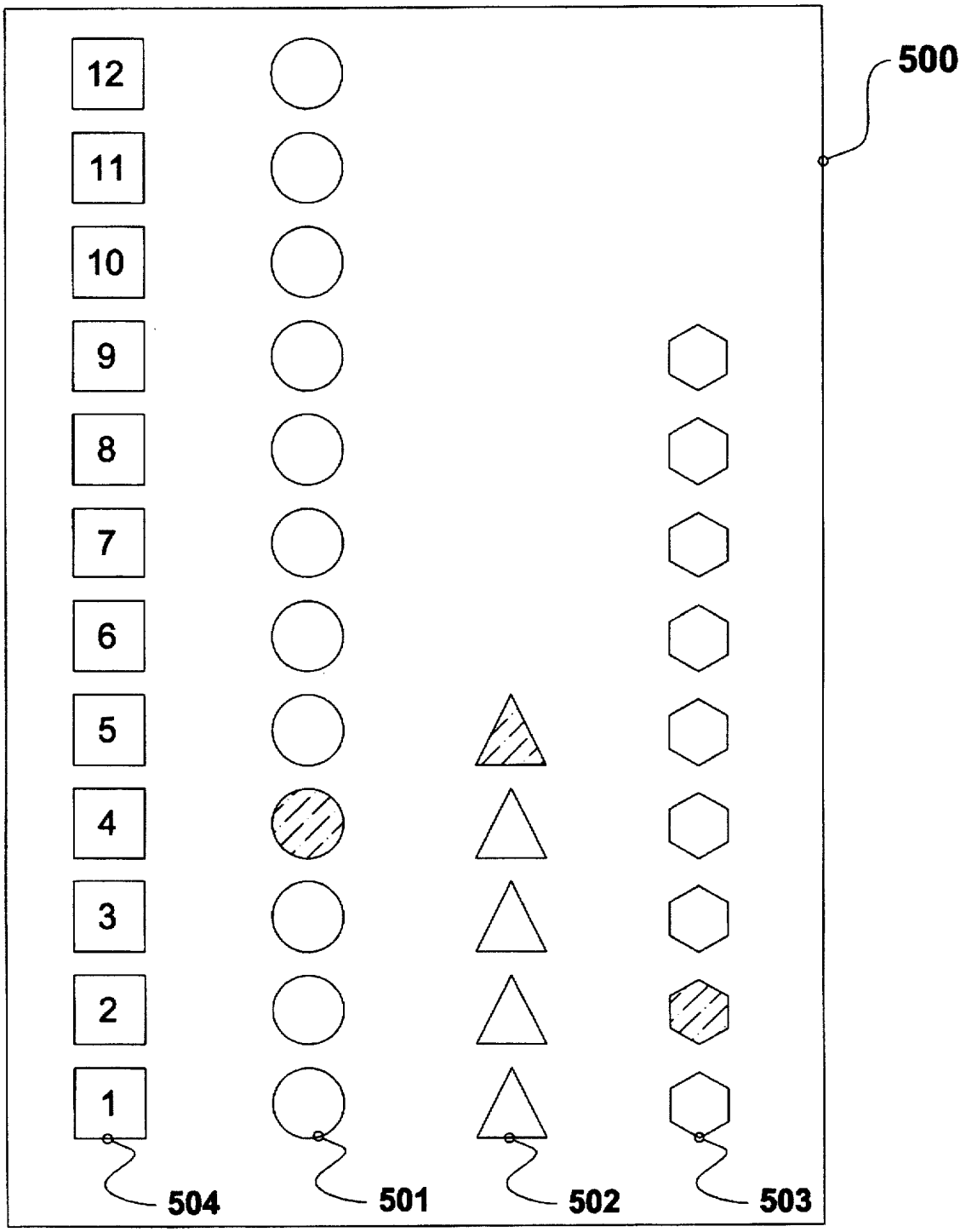
FIG. 7 is a further illustration of the embodiment of the present invention of FIG. 5 using a second method of displaying a particular time.

A variation of this second embodiment is shown in FIG. 7. In FIG. 7, rather than lighting a number of the indicators in each group as shown in FIG. 6, only that indicator which would be the uppermost is lit. For example, the indicator of the first group 501 which is adjacent the "4" in the column of numbers 504 is lit to indicate that the hour is four, a.m. or p.m. In the second group of indicators 502, the indicator even with the "5" in the column of numbers 504 is lit. In the third group of indicators, the indicator even with the "2" in the column of numbers 504 is lit. Thus, the time indicated by the timepiece 500 shown in FIG. 7 is 4:52 a.m. or p.m.

A further addition to any embodiment of the present invention may be a single indicator which exhibits one of two states and can be switched between these states. One of the two states would indicate a.m. and the other p.m.. Thus, the additional indicator would further clarify the time displayed by a timepiece according to the present invention if only twelve indicators are used in the first group of indicators.

It may also be desirable to add a means of indicating the passage of seconds to an embodiment of the present invention. For example, a sweeping second hand as used on a conventional analog clock may be added to an embodiment of the present invention, such as shown in FIG. 1. Alternatively, a circle of sixty small lights may be disposed around the perimeter of the timepiece 100 shown in FIG. 1 which are sequentially lighted in a clockwise direction, one being lighted each second. Each of these lights may remain on until all sixty are lit, or may only be on for one second until the next light in the sequence is lit.

Finally, the present invention may be implemented in a physical apparatus including the groups of indicators driven by a mechanical clock, a clock circuit or other time keeping device. An example may be a wristwatch driven by electronic circuitry. Alternatively, the present invention may be implemented as software on a computer, with the monitor displaying the three groups of indicators and the computer providing the driving clock circuit.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A timepiece comprising:

a first group of indicators each of which exhibit one of two states and each of which can be switched to exhibit either of said two states, wherein an amount of the indicators of said first group exhibiting one of said two states indicates an elapsed number of hours;

a second group of indicators, separate from said first group, each of which can exhibit one of two states and each of which can be switched to exhibit either of said two states, wherein each of the indicators of said second group represents ten minutes such that an amount of the indicators of said second group exhibiting one of said two states indicates an elapsed number of minutes in multiples of ten; and a third group of indicators, separate from said first and second groups, each of which can exhibit one of two states and each of which can be switched to exhibit either of said two states, wherein an amount of the indicators of said third group exhibiting one of said two states indicates an elapsed number of minutes up to nine;

wherein said first, second and third groups of indicators, taken together, indicate a time of day.

2. A timepiece as claimed in claim 1, wherein:

the number of indicators of said first group is twelve;

the number of indicators of said second group is five; and the number of indicators of said third group is nine.

3. A timepiece as claimed in claim 1, wherein:

the number of indicators of said first group is twenty-four;

the number of indicators of said second group is five; and the number of indicators of said third group is nine.

4. A timepiece as claimed in claim 1, wherein said first, second and third groups of indicators are arranged in substantially concentric circles.

5. A timepiece as claimed in claim 1, wherein said indicators are lights and said two states are on and off.

6. A timepiece as claimed in claim 1, wherein said indicators are mechanical items that shift between a first position and a second position.

7. A timepiece as claimed in claim 1, wherein after each passage of a predetermined interval of time the indicators of each of said first, second and third groups which are in said one of said two states are randomly changed.

8. A timepiece as claimed in claim 1, wherein said first second and third groups of indicators are distinguishable from each other by size, shape, color, orientation, spatial grouping or any combination thereof.

9. A timepiece as claimed in claim 1, further comprising an indicator for indicating ante-meridiem or post-meridiem.

10. A timepiece as claimed in claim 1, further comprising a column of numbers, wherein the indicators of said first, second and third groups are arranged, by group, into three columns next to said column of numbers.

11. A method of keeping and displaying time comprising:

providing a first group of indicators each of which can exhibit one of two states and each of which can be switched to exhibit either of said two states;

indicating an elapsed number of hours by an amount of the indicators of said first group exhibiting one of said two states;

providing a second group of indicators, separate from said first group, each of which can exhibit one of two states and each of which can be switched to exhibit either of said two states;

indicating an elapsed number of minutes in multiples of ten by an amount of the indicators of said second group exhibiting one of said two states, where each indicator of said second group represents ten minutes;

providing a third group of indicators, separate from said first and second groups, each of which can exhibit one of two states and each of which can be switched to exhibit either of said two states; and indicating an elapsed number of minutes up to nine minutes, by an amount of the indicators of said third group exhibiting one of said two states.

12. A method as claimed in claim 11, wherein:

said providing a first group of indicators comprises providing twelve indicators;

said providing a second group of indicators comprises providing five indicators; and said providing a third group of indicators comprises providing nine indicators.

13. A method as claimed in claim 11, wherein:

said providing a first group of indicators comprises providing twenty-four indicators;

said providing a second group of indicators comprises providing five indicators; and said providing a third group of indicators comprises providing nine indicators.

14. A method as claimed in claim 11, wherein said providing said first, second and third groups of indicators comprises arranging said first, second and third groups of indicators in substantially concentric circles.

15. A method as claimed in claim 11, wherein said indicators are lights and said two states are on and off.

16. A method as claimed in claim 11, wherein said indicators are mechanical items that shift between a first position and a second position.

17. A method as claimed in claim 11, further comprising randomly changing the indicators of each of said first, second and third groups which are in said one of said two states after each passage of a predetermined interval of time.

18. A method as claimed in claim 11, further comprising distinguishing said first second and third groups of indicators from each other by size, shape, color, orientation, spatial grouping, or any combination thereof.

19. A method as claimed in claim 11, further comprising indicating with an indicator ante-meridiem or post-meridiem.

20. A method as claimed in claim 11, further comprising:

arranging said first, second and third groups into three columns, one column per group; and disposing a column of numbers next to said columns of indicators.

* * * * *